US005580315A

United States Patent [19]

Katz

[11] Patent Number: 5,580,315

[45] Date of Patent: Dec. 3, 1996

[54] RECREATIONAL APPLIANCE

[75] Inventor: Steen Katz, Ringe, Denmark

[73] Assignee: Kompan A/S, Ringe, Denmark

[21] Appl. No.: 493,963

[22] Filed: Jun. 23, 1995

[30] Foreign Application Priority Data

Jul. 4, 1994 [DK] Denmark ..... 0783/94

[51] Int. Cl.[6] ..... A63G 13/08

[52] U.S. Cl. ..... 472/104; 472/100; 267/179

[58] Field of Search ..... 472/95, 103, 104, 472/105, 100; 248/624, 581, 500, 316.2; 267/179

[56] References Cited

U.S. PATENT DOCUMENTS

| | | | |
|---|---|---|---|
| 1,850,927 | 3/1932 | Frederick | 472/104 |
| 4,093,198 | 6/1978 | Petersen | 472/104 X |
| 4,351,521 | 9/1982 | Erdos | 472/104 |
| 4,379,550 | 4/1983 | Petersen | 472/104 |
| 4,728,087 | 3/1988 | Wils | 472/104 X |

FOREIGN PATENT DOCUMENTS

| | | | |
|---|---|---|---|
| 3941489 | 2/1991 | Germany | 267/179 |
| 9217340 | 12/1992 | Germany . | |

*Primary Examiner*—Kien T. Nguyen

*Attorney, Agent, or Firm*—McAulay Fisher Nissen Goldberg & Kiel

[57] ABSTRACT

A recreational appliance with springs (1) is provided with a locking element (2–9) which can be inserted in an anchoring element with a receiving flange (4), whereby a recreational appliance can be locked to the fundament in such a manner that it can be removed after it has been unlocked. The lock is preferably configured to have two lock plates (5) which engage bolt retaining edges (15) in the flange (4), which is provided with a recess (14) in which the locking element (2–9) is inserted. A recreational appliance can then function in the same way as an ordinary permanently ground anchored appliance, but the locking element makes it possible to remove the appliance after it has been unlocked, for area maintenance or repairs, or to avoid damage to the recreational appliance.

11 Claims, 5 Drawing Sheets

RECREATIONAL APPLIANCE

BACKGROUND OF THE INVENTION

The invention relates to a recreational appliance of the kind which comprises a seat or support part which is secured to the uppermost end of a coil spring, and where the lowermost end of the spring is secured to an anchoring element which is anchored in the ground so that the seat or the support part can carry out rocking movements.

Recreational appliances of this kind are very popular and are set up to a great extent on playgrounds and similar places with public access. This gives children the possibility of engaging in an enjoyable and stimulating activity.

When a recreational appliance has been erected, it is difficult to maintain the area around the appliance, in that during grass-cutting, sweeping and snow-clearing it is necessary to manoeuvre around the appliance. This is naturally a disadvantage, the reason being that it makes maintenance more troublesome.

Moreover, in some cases the appliance is an obstruction when the surface around the appliance needs to be repaired.

Where the recreational appliances are erected in public places, such as parks and shopping centres and the like, there is also the risk that the appliances are exposed to malicious damage. This can be in the form of slashed seats and similar damage which can render the appliance unusable or inconvenient.

OBJECT OF THE INVENTION

According to the invention, and anchoring element has a receiving part on a level with the ground surface and a removable locking part provided with locking means to which the spring is secured, which locking part can be locked to the receiving part. The prior disadvantages can be eliminated in a simple manner, in that the actual recreational appliance with the spring can be locked to the receiving element anchored in the ground, so that the appliance is made secure both with regard to the recreational activity as well as against removal. But to this can be added that the appliance can be released from the receiving part, which means that the maintenance of the area around the appliance is made considerably easier, and that the appliance can be removed and stored away, e.g. during periods when the shops are closed and there is thus a lack of surveillance.

Malicious damage and destruction of the recreational appliance is thus avoided, and by the configuration of standarized equipment, the individual appliances can be moved around and thus provide a variation of the appliances with regard to both configuration and characteristics.

Since the locking equipment is configured in such a way that it does not diminish the utilization or weaken the strength of the erected appliance, this equipment can be used not only for permanent erection but also for the above-mentioned temporary erection.

In one embodiment of the invention the receiving part has a flange recess with diametrically opposed retaining surfaces. The locking means has diametrically opposed movable plates such that an assembly and locking-together can be achieved in a simple manner by movement of the plates away from each other.

Further, by configuring the recess so that its opposite edges form plate retainers, the flange will function as a lock plate.

Preferably, the movable locking elements are plates which can slide on a single guide during the movement.

By letting the plates be guided at the side as well as in height, there can be achieved a precisely-controlled plate movement without play and clearance.

By providing the plates with holes in which a pin on a separate key can engage, the plates can be moved by turning the key, which is thereafter removed.

An easy and precise operation of the lock is achieved by configuring the key and the recess so that the amount of turning movement of the key is sufficient to engage the lock.

A placing a rib or distance piece can be inserted between the separated plates when in the plates locked position, to prevent the plates from being moved.

Finally, it is expedient to provide a separate plate part with such a rib, or to provide a separate plate configured to cover over the recess, when the recreational appliance has been removed.

BRIEF DESCRIPTION OF THE DRAWINGS

In the following, an example embodiment of the invention will be described with reference to the drawing, where.

DESCRIPTION OF THE EXAMPLE EMBODIMENT

Figure 1:
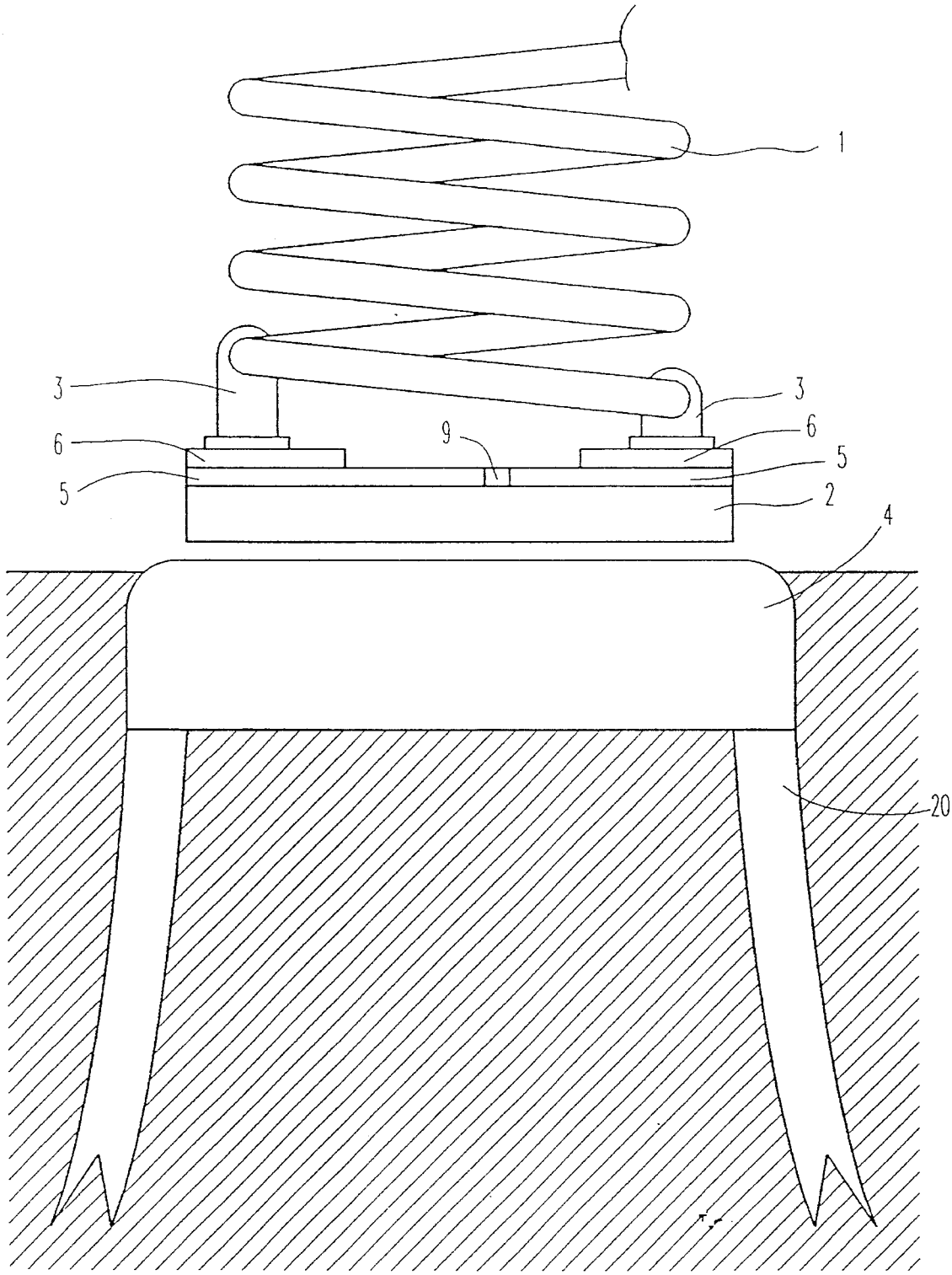
FIG. 1 shows the lowermost part of the spring with locking means, and the receiving part anchored in the ground.

In FIG. 1, the parts to which the invention relates are seen from the side.

As shown in FIG. 1, the element anchored or secured in the ground or other fundament comprises a flange part 4 which is preferably made of steel plate.

In the example shown, the flange part 4 is provided with a number of anchoring legs 20 which secure the flange part in a cast fundament.

However, the flange part 4 can be provided with other anchoring or securing means, such as ground anchors, base-bolts and the like. The essential factor is that the flange part 4 is safely and immovably secured in a position in which the upper side extends in or closely to the surface of the ground, as shown in FIG. 1.

Figure 2:
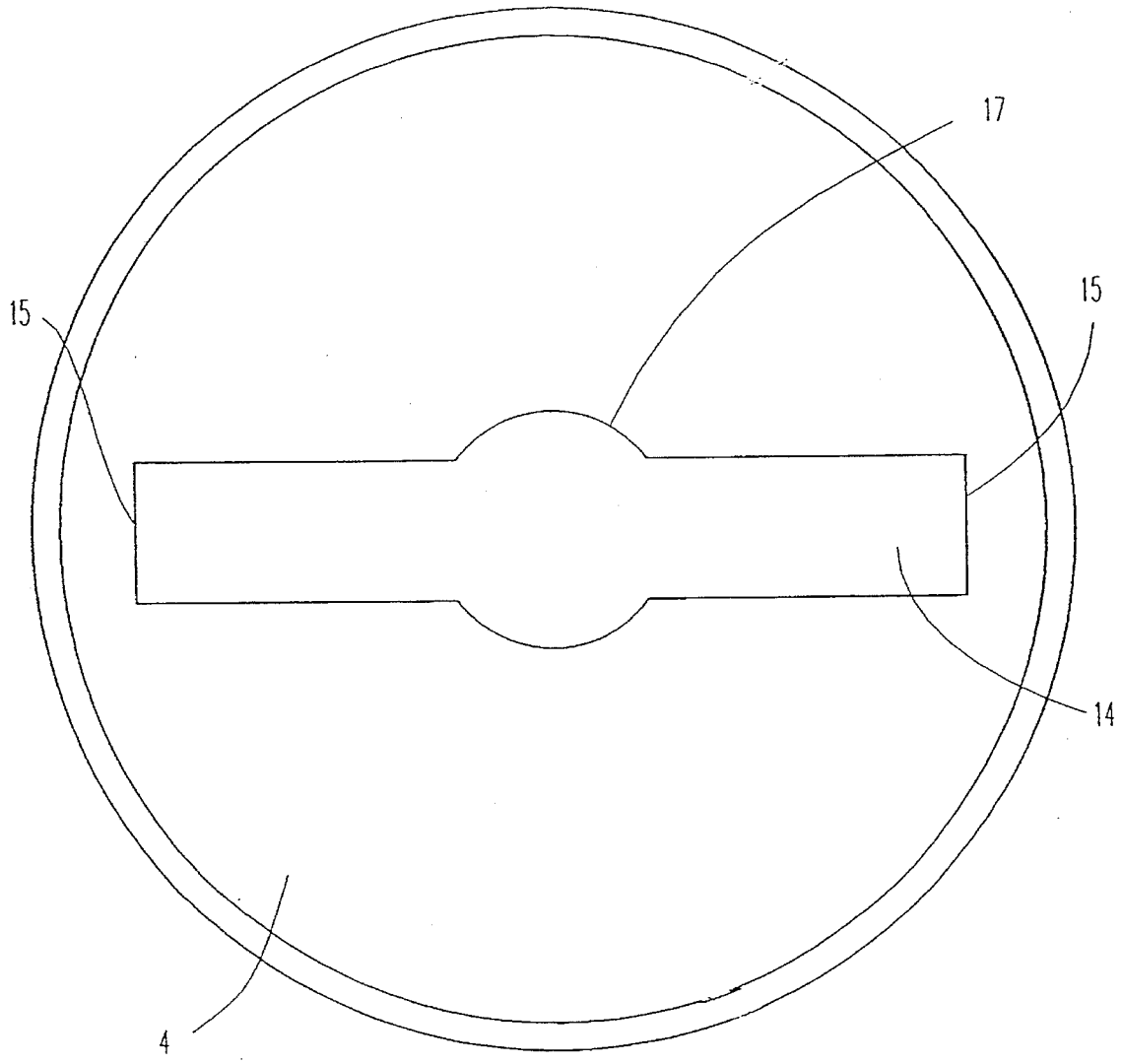
FIG. 2 shows the flange on the receiving part seen from above.

FIG. 2 shows the flange part 4 seen from above, and it will be noted that there is a transversely-extending recess 14 which functions as the receiving hole for the locking element, as will be described later.

As seen in FIG. 1, the locking element is located at the lower end of the spring 1.

The locking element has two spring clamps 3 which are tightened around the spring winding to secure the spring to the locking element. The locking element has two baseplates 6 under each spring clamp 3 and two lock plates 5 which can be moved in and out in the horizontal plane on a support piece 2 which constitutes the support part.

Figure 3:
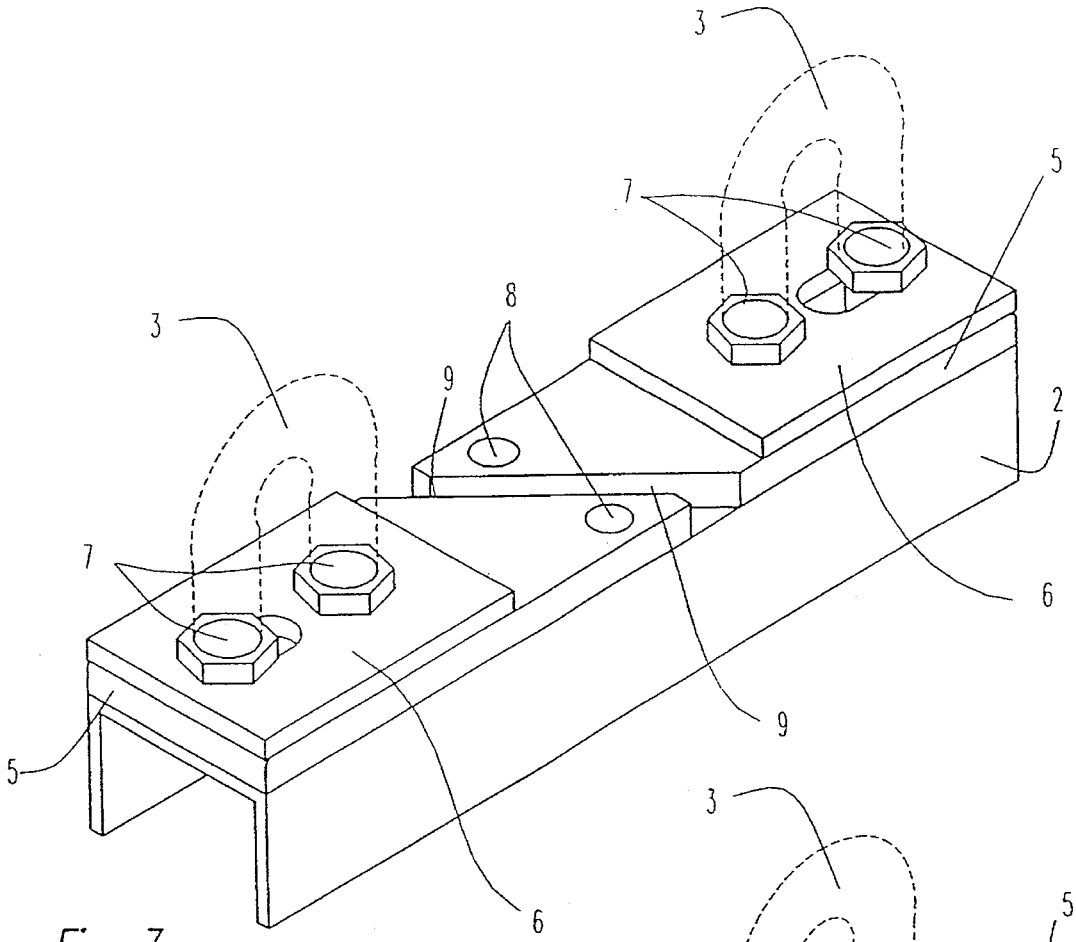
FIG. 3 shows the lock itself with lock plates in the unlocked position.
Figure 4:
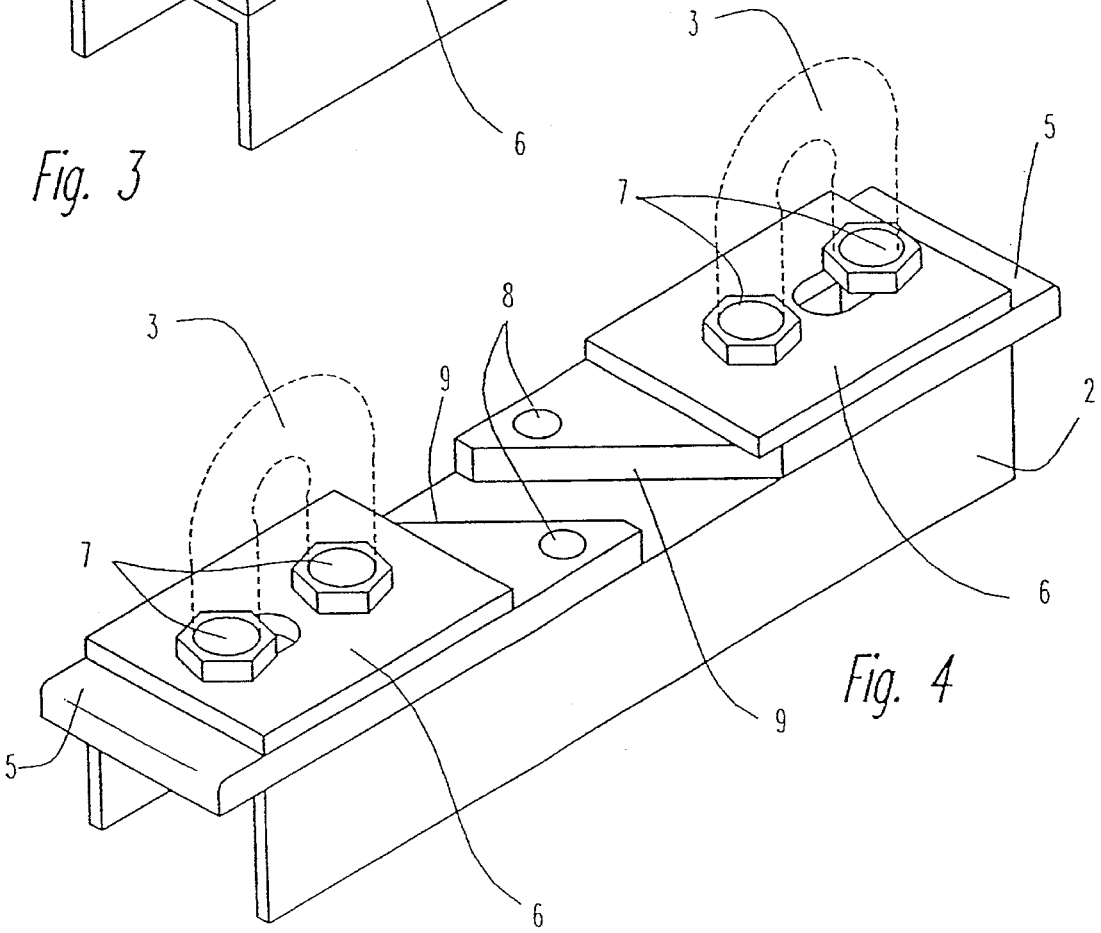
FIG. 4 shows the lock in the locked position.

The actual locking arrangement is shown in FIGS. 3 and 4, where the two spring clamps 3 are shown with stippled lines. These clamps can be configured in various ways and be secured to the base in different ways, which in the example shown comprises a U-shaped support piece 2.

On the top of this support piece 2 there are placed two lock plates 5 which, as shown in FIG. 3, are flush with the end edges of the support piece 2, and which are cut at an angle at the opposite ends to form diagonally-extending end surfaces 9.

In each of the two plates 5 there are provided two elongated guideways (not shown) for two slide stays 7, which can possibly be in connection with the spring clamp 3.

These two sets of stays 7 cooperate with the guideways in the plates 5 so that the plates can be moved in a longitudinal direction on the support piece 2, i.e. between the locking position shown in FIG. 4 and the retracted position shown in FIG. 3.

It will be seen that in each of the plates 5 there is a hole 8 which is placed in the pointed section of the plate. In FIG. 3 it will be seen that the holes 8 extend transversely to the longitudinal direction of the plate 5, and in FIG. 4 that they extend at an angle in relation hereto.

The working mode of the lock will now be described in more detail with reference to FIG. 5. This shows the locking element with the not-shown spring secured by means of the spring clamps 3 which are sunk into the recess 14 in the flange 4, in that the support piece 2 with the plates 5 in the retracted position corresponding to FIG. 3 can be pressed down in the recess.

Once in position, the two plates 5 are moved outwards as indicated by stippled lines, and which corresponds to FIG. 4, whereby the plates 5 will serve as locking plates, in that the plate ends will be pushed in under the edge 15 at the end of the recess 14 in the flange 4.

Figure 5:
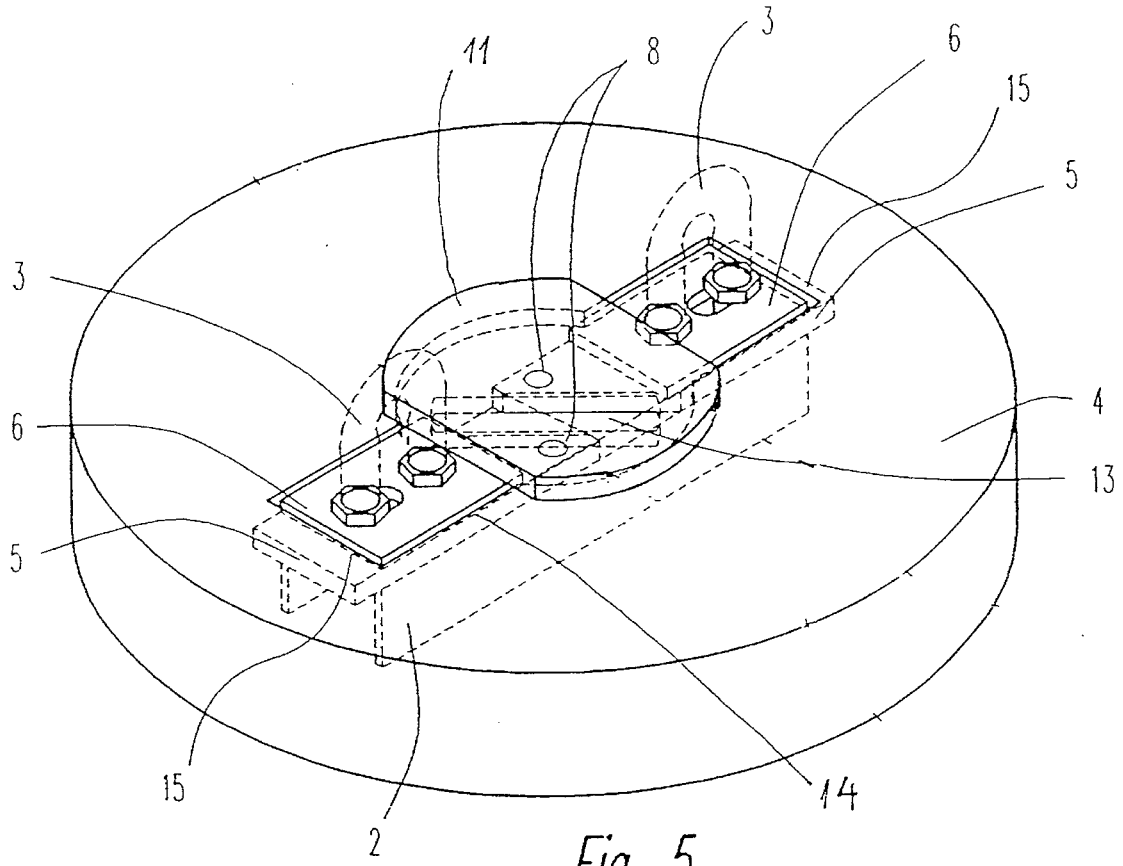
FIG. 5 shows the receiving part in the locked position and with a first lock coverplate.

In this position, the locking element with spring is secured in the receiving element as shown in FIG. 5, and thus an appliance attached to the spring will be fixed in position.

Figure 7:
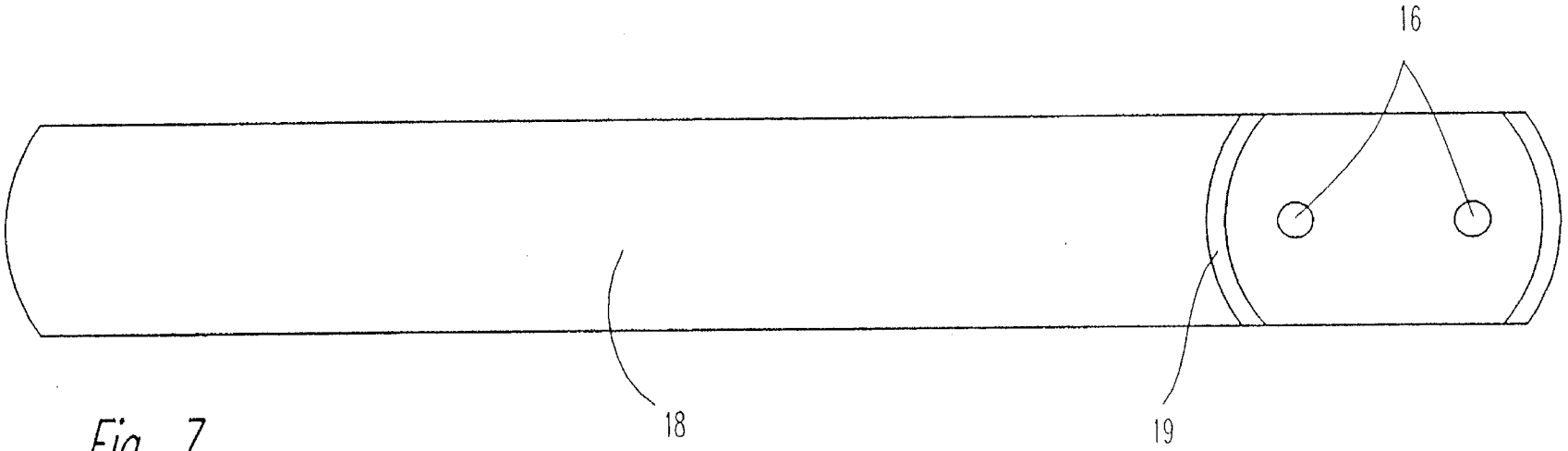
FIG. 7 shows the key seen from below.
Figure 8:
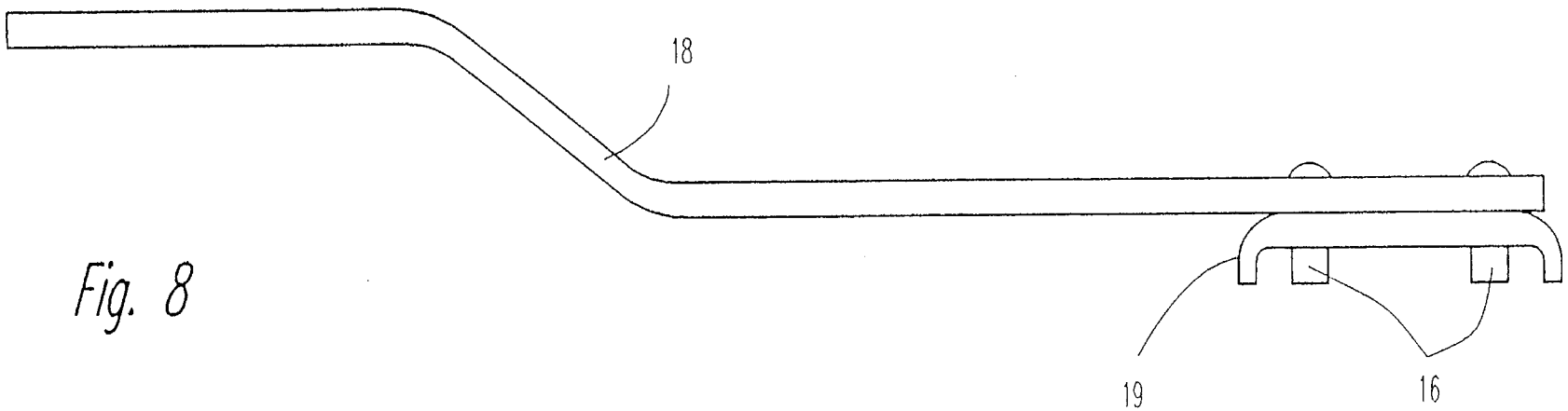
FIG. 8 shows the key seen from the side.

The outwards displacement of the two locking plates 5 can be effected by means of a key 18 shown in FIGS. 7 and 8 with two studs 16 and ribs 19.

The studs 16 fit down in the holes 8 in the plates 5, and the ribs 19 can slide towards the central recess 17 in the receiving hole 14 in the flange 4, as shown in FIG. 2.

When the key 18 is inserted, it can be turned clockwise, whereby the locking plates 5 will be displaced outwards and will engage under the bolt locking edge 15 on the flange 4.

In order to ensure that the plates 5 remain out in the locked position, a tumbler in the form of a rib 13 is provided on a separate cover-piece 11, as shown in FIG. 5.

As indicated in FIG. 5, the rib 13 extends in the space between the two inclined end surfaces 9 on the plates 5, whereby said bolts are prevented from being moved back and thus unlock the element.

The pressing-down of the cover-plate 11 enables it to be secured, while at the same time it serves as retainer and protects the lock.

The cover-plate 11 is positioned when the parts have been locked together, and is not removed until the recreational appliance needs to be taken away.

After removal of the cover-plate 11, the key 18 can again be positioned with the studs 16 in the holes 8 and then turned anti-clockwise. The plates 5 are then displaced inwards and the appliance can be removed from its fundament.

Figure 6:
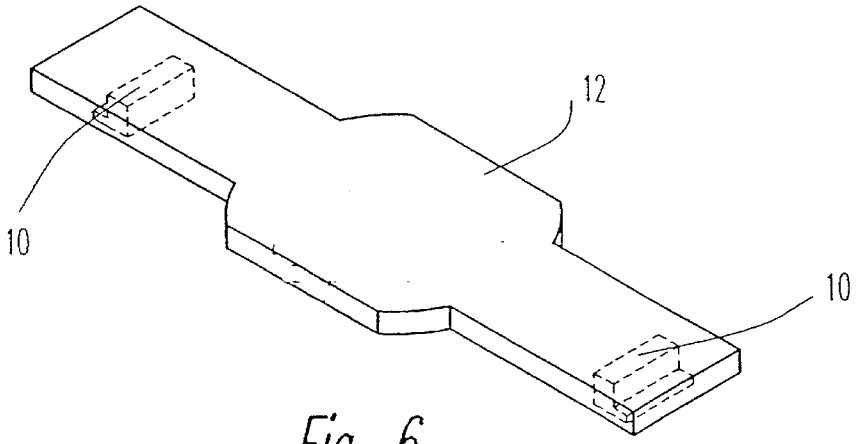
FIG. 6 shows a recess coverplate itself seen from above.

In order to cover the recess 14 when the appliance has been removed, a second cover-plate 12 as shown in FIG. 6 can be used. This is secured in the recess by the projections 10 which clamp against the plate locking edges 15.

The receiving hole 14 is then protected against being filled with earth, sand or the like, which would prevent the locking element from being able to be engaged in the flange.

When the recreational appliance is to be erected again, the cover-plate 12 is removed and the locking element is inserted and secured as already explained.

I claim:

1. A recreational appliance comprising a support part, secured to an uppermost end of a coil spring, an anchoring element having a lowermost end of the spring secured thereto, for anchoring in the ground so that rocking movements can be effected, the anchoring element having a receiving part on a level with the ground surface and a locking part, the locking part having means to secure the spring thereto, the locking part having movable means for locking the locking part to the receiving part.

2. Recreational appliance according to claim 1, characterized in that the receiving part comprises a flange (4) with two diametrically opposed retaining surfaces (15), and removable locking means having two plates (5) which can be moved to enter into both a locking engagement and a releasing engagement with the flange (4).

3. Recreational appliance according to claim 2, characterized in that each retaining surface is configured in the flange as an end surface in a recess (14) in which the locking part can be sunk.

4. Recreational appliance according to claim 3 characterized in that the plates (5) can be moved in the outwards and inwards direction in relation to each other in the locking part.

5. Recreational appliance according to claims 2 characterized in that the plates (5) which can be moved in the outwards and the inwards direction in relation to each other in the locking part.

6. Recreational appliance according to claim 5, characterized in that plates (5) can only be moved in one plane.

7. Recreational appliance according to claim 5, characterized in that in each bolt plates plate (5), adjacent to their inwardly-facing ends and at opposite sides of the plates, there is provided a hole (8) in which one of two studs (16) on a separate key (18) can engage.

8. Recreational appliance according to claim 7, characterized in that the key (18) has circular or circular-segment formed guide ribs (19), in that said ribs (19) can slide within a circular or circular-segment formed recess (17) in the flange (4).

9. Recreational appliance according to claim 5, characterized in that a distance piece (13) can be placed between the inwardly-facing ends (9) of the plates (5) to prevent unintentional inwards movement of the plates (5).

10. Recreational appliance according to claim 9, characterized in that the distance piece (13) is provided on a separate plate part (11) which can be placed over the recess (14) in the flange (4).

11. The recreational appliance according to claim 2 further comprising a second cover plate having projections which clamp against the retaining surfaces, for covering the recess when the appliance has been removed.

* * * * *